US008459758B2

(12) United States Patent
Rechberg et al.

(10) Patent No.: US 8,459,758 B2
(45) Date of Patent: Jun. 11, 2013

(54) DRAWER SLIDE AUTO-CLOSE DAMPENING SYSTEM WITH RESET FEATURE

(75) Inventors: Frank H. Rechberg, Corona, CA (US); Jason A. Rechberg, Anaheim, CA (US)

(73) Assignee: Actron Manufacturing, Inc., Corona, CA (US)

( * ) Notice: Subject to any disclaimer, the term of this patent is extended or adjusted under 35 U.S.C. 154(b) by 441 days.

(21) Appl. No.: 12/691,097

(22) Filed: Jan. 21, 2010

(65) Prior Publication Data

US 2011/0175508 A1 Jul. 21, 2011

(51) Int. Cl.
*A47B 88/04* (2006.01)

(52) U.S. Cl.
USPC ..... 312/333; 312/319.1

(58) Field of Classification Search
USPC ..... 312/319.1, 330.1, 333, 334.1, 334.7, 312/334.8, 334.44, 334.46, 334.47; 384/21, 384/22
See application file for complete search history.

(56) References Cited

U.S. PATENT DOCUMENTS

| | | | | |
|---|---|---|---|---|
| 1,557,765 | A | 10/1925 | Nicholas | |
| 1,910,208 | A | 5/1933 | Gronberg et al. | |
| 2,547,513 | A | 4/1951 | Wikman | |
| 2,752,219 | A | 6/1956 | Yonkers | |
| 3,074,766 | A | 1/1963 | Meyer | |
| 3,259,447 | A | 7/1966 | Deutsch | |
| 3,401,998 | A | 9/1968 | Evans et al. | |
| 3,773,395 | A | 11/1973 | Antonaccio | |
| 3,801,166 | A | 4/1974 | York | |
| 3,937,531 | A | 2/1976 | Hagen et al. | |
| 4,067,632 | A | 1/1978 | Sekerich | |
| 4,423,914 | A | 1/1984 | Vanderley | |
| 4,441,772 | A | 4/1984 | Fielding et al. | |
| 4,469,384 | A | 9/1984 | Fler et al. | |
| 4,537,450 | A | 8/1985 | Baxter | |
| 4,749,242 | A | 6/1988 | Rechberg | |
| 4,932,792 | A | 6/1990 | Baxter | |
| 4,988,214 | A | 1/1991 | Clement | |
| 5,207,781 | A * | 5/1993 | Rock | 312/319.1 |
| 5,474,375 | A * | 12/1995 | Hollenstein et al. | 312/319.1 |
| 6,126,255 | A | 10/2000 | Yang | |
| 6,244,678 | B1 | 6/2001 | Dopp et al. | |
| 6,435,636 | B1 | 8/2002 | MacMillan | |
| 7,374,260 | B2 * | 5/2008 | Lu | 312/333 |
| 7,513,582 | B2 * | 4/2009 | Yoon et al. | 312/333 |
| 7,537,296 | B2 | 5/2009 | Leon et al. | |
| 8,132,873 | B2 * | 3/2012 | Yang | 312/333 |
| 2007/0114896 | A1 * | 5/2007 | Orita | 312/334.14 |
| 2008/0218046 | A1 | 9/2008 | Rechberg | |

OTHER PUBLICATIONS

Photographs (2) of showing a Carrier and Piston by RD Hardware (www.rdhardware.com).

* cited by examiner

*Primary Examiner* — James O Hansen
(74) *Attorney, Agent, or Firm* — Stetina Brunda Garred & Brucker

(57) ABSTRACT

A drawer slide with an auto close dampening system with reset feature is disclosed. The drawer slide may incorporate a stationary slide member attached to a frame of the drawer and a pin in fixed relative position to a drawer box of the drawer. A carriage is attached to the stationary slide member and has an actuator that is releasably engageable with the pin. The actuator works in conjunction with the pin to automatically close the drawer box to the closed position. During malfunction, the actuator is drawn back to a retracted position so that the auto close mechanism no longer automatically closes the drawer box when the drawer box is traversed to the closed position. The actuator includes a ramp so that the pin may be pushed over the ramp and engage back with the actuator to reset the auto close mechanism.

8 Claims, 6 Drawing Sheets

DRAWER SLIDE AUTO-CLOSE DAMPENING SYSTEM WITH RESET FEATURE

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present invention relates generally to a drawer slide, and more particularly, to an auto-close dampening system incorporated into the drawer slide with a reset feature.

Drawer slides are mounted to opposed sides of a drawer box to allow the drawer box to slide in and out of a cabinet or other frame. In certain instances, the drawer slides assist the user in closing the drawer box to the fully closed position. Additionally, once the drawer box is in the fully closed position, the drawer slides maintain the drawer box in the closed position despite external forces that may urge the drawer box to the opened position. In operation, as the user pushes the drawer box closed, an auto close mechanism engages the drawer box at the end of the closing section and gently pulls the drawer box to the fully closed position and maintains the drawer box in the closed position. Unfortunately, sometimes the auto close mechanism fails or malfunctions. In this instance, the auto close mechanism is rendered inoperable. The auto close mechanism fails to pull the drawer box to the fully closed position. Also, when the auto-close mechanism is inoperable, the drawer box may inadvertently be traversed to the opened position. If the drawer box is employed in an airplane or is meant to be earthquake proof, then the drawer box would open as the plane rolls or pitches or during the occurrence of an earthquake. To render the auto-close mechanism operable once again, the drawer box and frame of the drawer must be disassembled to fix the auto-close mechanism.

Accordingly, there is a need in the art for an improved more reliable auto close mechanism and a more convenient method to fix a malfunctioning auto-close mechanism.

BRIEF SUMMARY

The drawer slide auto close dampening system with reset feature disclosed herein addresses the needs discussed above, discussed below and those that are known in the art.

The drawer slide disclosed herein may be attached to both a frame of a drawer and a drawer box. The auto close mechanism may include a carriage attached to a stationary slide member and a pin in fixed relative position with respect to a telescoping slide member and the drawer box. The carriage incorporates an actuator that is releasably engageable to the pin. The actuator is traversable between a retracted position wherein the drawer box is in the closed position and an extended position wherein the drawer box is being traversed toward the opened position. At the extended position, the actuator is also pivotable between an engaged position and a released position. In operation as the drawer box is traversed from the closed position to the opened position, the pin is engaged to the actuator. When the actuator reaches the extended position, the pin is released from the actuator and also pushes or rotates the actuator to the released position.

The drawer box is now freely traversable to the fully opened position so that the user may access the interior compartment of the drawer box. In relation to the actuator, when the actuator is in the released position, the actuator is held in the extended and released position until the user pushes the drawer box back to the closed position to reengage the pin to the actuator. When the pin is reengaged to the actuator, the actuator is pivoted back up to the engaged position and the actuator being biased toward the retracted position pulls the drawer box closed. Sometimes, when the pin is released from the actuator, the actuator is supposed to pivot to the released position and remain in the released and extended position until the drawer box is pushed back to the closed position. However, during a malfunction, the actuator may release the pin but be inadvertently pivoted back toward the engaged position even though the pin is not engaged to the actuator. In this instance, the actuator will retract back to the retracted position even though the pin is not engaged to the actuator. The drawer box is freely openable and accessible. Fortunately, the actuator has a reset feature. In particular, the actuator may have a ramp that is aligned to the pin so that the pin may ride over the ramp and reengage a catch of the actuator to reset the auto close mechanism. When the drawer box is reopened, the auto close mechanism will work as needed unless another malfunction occurs.

More particularly, a slide for a drawer having a frame and a drawer box is disclosed. The slide may comprise a stationary slide member, telescoping slide member, and an auto close mechanism with reset feature. The stationary slide member may be attached to a frame of the drawer. The telescoping slide member may be slideable with respect to the stationary slide member between an extended position and a retracted position. The telescoping slide member may be attachable to a drawer box of the drawer for traversing the drawer box between an opened position and a closed position. The auto close mechanism may be attached to both the stationary and telescoping slide members.

The auto close mechanism may comprise a pin and an actuator. The pin may be in fixed relative position with respect to the telescoping slide member and the drawer box. The actuator may be biased toward a retracted position and traversable to an extended position as the drawer box is traversed to the opened position. The actuator may have a catch and may be pivotable between (1) an engaged position so that the actuator and the pin are in fixed relative position to each other for auto closing the drawer box and (2) a release position so that the pin is released from the actuatory for allowing the drawer box to be traversed to the opened position. The actuator may define a leading portion having a ramp configuration for resetting the auto close mechanism when the actuator is inadvertently traversed to the engaged position when the drawer box is in the opened position.

The auto close mechanism may further comprise a carriage attached to the stationary slide member and a dampener mounted to the carriage and attached to the actuator for dampening movement of the drawer box to the closed position after the actuator engages the pin. The dampener may be a strut including a shock absorber and a shaft which is traversable in and out of the shock absorber. A distal end portion of the shaft may be pivotally attached to the actuator. The actuator may be rotatable between engaged and released positions.

The ramp may be aligned to the path of travel of the pin so that the pin can ride up on the ramp and reengage the catch for resetting the auto close mechanism when the actuator is inadvertently traversed to the engaged position when the drawer box is in the open position. A ramp surface of the ramp may be aligned to a distal end of the pin. The ramp may be disposed in front of the catch to allow the ramp to push the pin over ramp and into the catch of the actuator.

The auto close mechanism may comprise a strut attached to the actuator for dampening movement of the drawer box as it is traversed to the closed position, and a spring attached to the actuator for auto closing the drawer box back to the closed position.

Additionally, a method of resetting an auto close mechanism of a drawer is disclosed. The method may comprise the steps of providing the auto close mechanism attached to the drawer, the auto close mechanism having an actuator traversed to an engaged position with a pin engaged to a catch of the actuator; pulling a drawer box to an opened position; during the pulling step, increasing a bias applied to the drawer box to a closed position until the actuator is traversed to a release position and the pin is disengaged from the catch of the actuator; after the pin is disengaged from the catch, traversing the drawer to the opened position; and with the actuator inadvertently traversed back to the engaged position with the pin disengaged from the catch of the actuator, traversing the drawer box toward the closed position; and during the traversing step, engaging the pin with a ramp of the actuator to push the pin over the ramp and into the catch for resetting the auto close mechanism.

The method may further include the step of pulling the drawer box toward the closed position with a spring. The step of pulling the drawer box to the opened position may include the step of overcoming a bias force (e.g., spring bias force) urging the drawer box toward the closed position. The engaging the pin with the ramp step may further include the step of laterally displacing the pin over the ramp.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
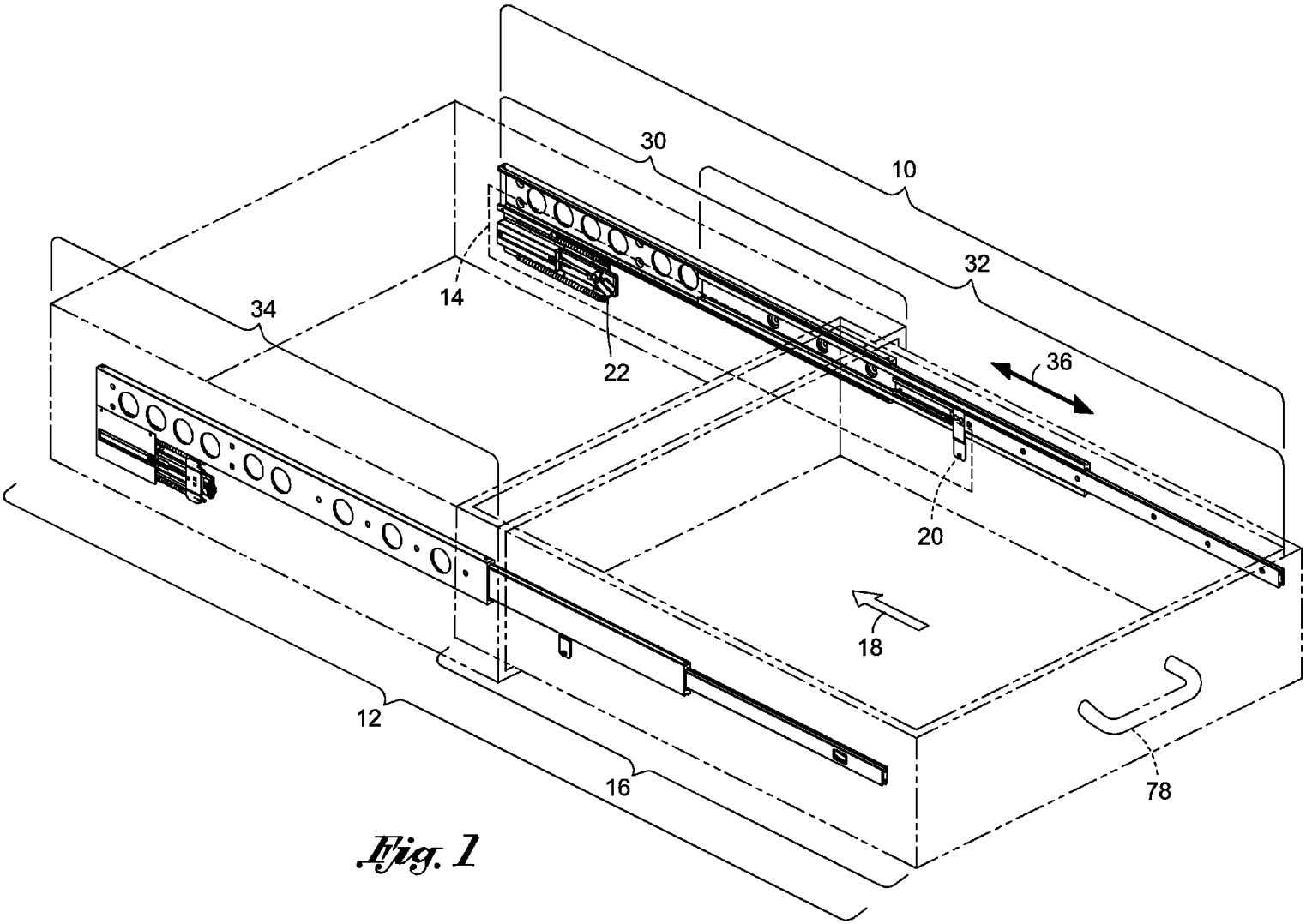
FIG. 1 is a perspective view of a drawer slide auto-close-dampening system with reset feature.

Referring now to the drawings, a slide 10 for a drawer 12 is shown. The slide 10 incorporates an auto close mechanism 14 to assist in closing the drawer 12 and to maintain the drawer 12 in the closed position. As a drawer box 16 of the drawer 12 is traversed from an open position (see FIG. 1) to a closed position by traversing the drawer box 16 in the direction of arrow 18 (see FIG. 1), a pin 20 (see FIG. 2) attached to the drawer box 16 engages an actuator 22 attached to a frame 34 of the drawer 12. When the pin 20 engages the actuator 22, the actuator 22 is traversed from the released position (see FIG. 2) to the engaged position (see FIG. 3). The actuator 22 is now engaged to the pin. The springs 24 draw the actuator 22 from the extended position (see FIG. 3) to the retracted position (see FIG. 4) and the drawer box 16 to the closed position.

Figure 5:
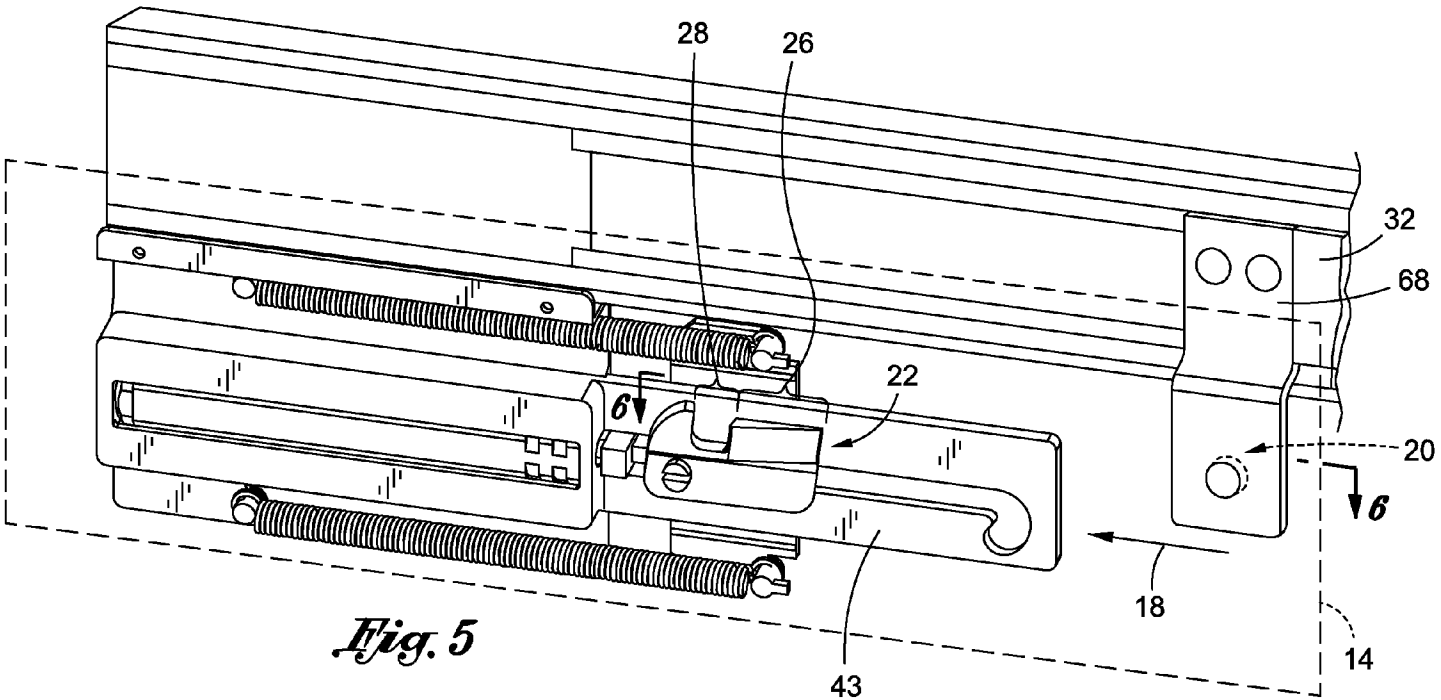
FIG. 5 is a perspective view of the auto-close-dampening system with reset feature wherein the actuator is in the engaged and retracted position but a pin is not disposed in a catch of the actuator.
Figure 6:
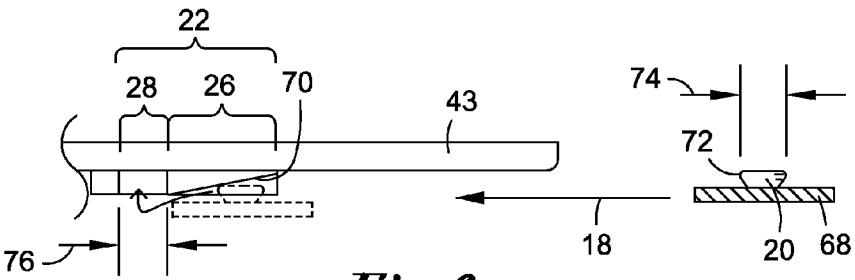
FIG. 6 is a top cross sectional view of the auto-close dampening system with reset feature shown in FIG. 5.

Inadvertently, the actuator 22 may be traversed to the engaged position even though the pin 20 is not engaged to the actuator 22, as shown in FIG. 5. In this instance, the drawer box 16 is not automatically closed as discussed above. Rather, the user must push the drawer box 16 until the drawer box 16 is in the closed position. If the auto close mechanism 14 is not reset after this malfunction, then the drawer box 16 may be accidentally traversed to the open position. For example, in an airplane environment, the airplane may pitch and roll applying forces to the drawer box. Since the auto close mechanism 14 is not reset or the pin 20 is not reengaged to the actuator 22, the drawer box 16 is free to open when the airplane pitches and rolls. Fortunately, the auto close mechanism 14 has a reset feature which allows the auto close mechanism to be quickly and easily reset after a mechanical failure. In particular, the actuator 22 has a ramp 26 (see FIG. 5) that allows the pin 20 to be pushed over the ramp 26 and back into a catch 28 of the actuator 22 to reset the auto close mechanism 14, as shown in FIG. 6. After the auto close mechanism 14 is reset, the drawer box 16 will not be accidentally traversed to the open position. The springs 24 and a shock absorber 42 help to maintain the drawer box 16 at the closed position. Additionally, when the drawer box 16 is pulled out a subsequent time, the auto close mechanism 14 will behave as normal (e.g., assist in auto closing the drawer box, etc.) provided that the actuator 22 is not inadvertently traversed back to the engaged position even though the pin 20 is not disposed in the catch 28.

More particularly, referring now to FIG. 1, two slides 10 are shown as being attached to lateral sides of drawer box 16 and medial sides of the frame 34. The slide 10 and auto close mechanism 14 will be discussed in relation to one of the slides 10. However, the other slide 10 on the opposed side of the drawer box 16 may operate in substantially the same fashion and may have a mirror configuration.

The slide 10 may include one stationary slide member 30 and at least one telescoping slide member 32. The stationary slide member 30 may be fixedly attached to a frame 34 of the drawer 12 by way of screws, adhesive, nut and bolt connection, etc. The frame 34 is being shown as a cabinet. However, it is contemplated that the frame 34 may be any type of overhead cabinetry, under the shelf cabinetry, a desk drawer, a stand, etc. The telescoping slide member 32 may slide into and out of the stationary slide member 30 in the direction of arrow 36 (see FIG. 1). The telescoping slide member 32 may be fixedly attached to the drawer box 16 also by way of screws, adhesive, nut and bolt connection, etc. The slide 10 is being described and shown in relation to the drawer box 16. However, it is also contemplated that the slide 10 may also be incorporated on a shelf, or other object that needs to be slid in and out of position. The drawer box 16 may be traversed to the open position shown in FIG. 1 wherein the user may access the interior of the drawer box 16 or to the closed position wherein the drawer box 16 is disposed within the frame 34 so that the contents within the drawer box 16 do not fall out or the drawer box 16 is not unintentionally traversed to the opened position.

Figure 2:
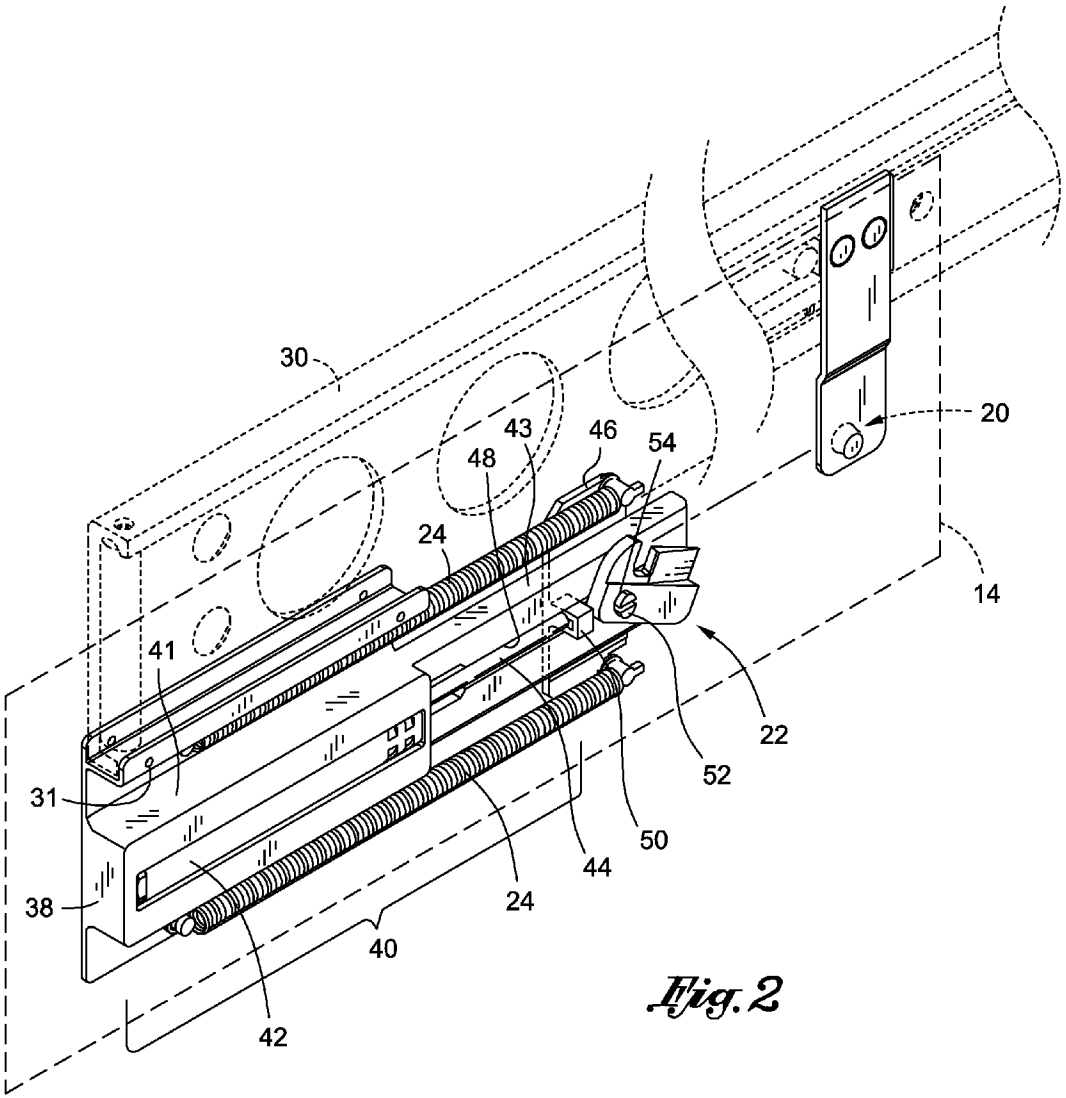
FIG. 2 is an enlarged view of the auto-close-dampening system with reset feature shown in FIG. 1.
Figure 3A:
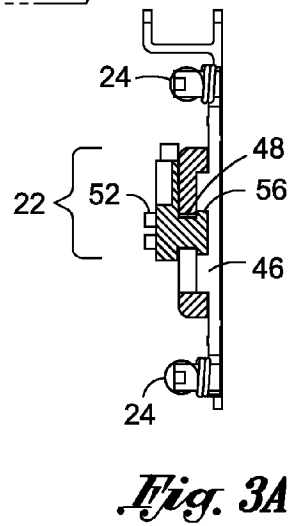
FIG. 3A is a cross section view of the auto close dampening system shown in FIG. 3.
Figure 3:
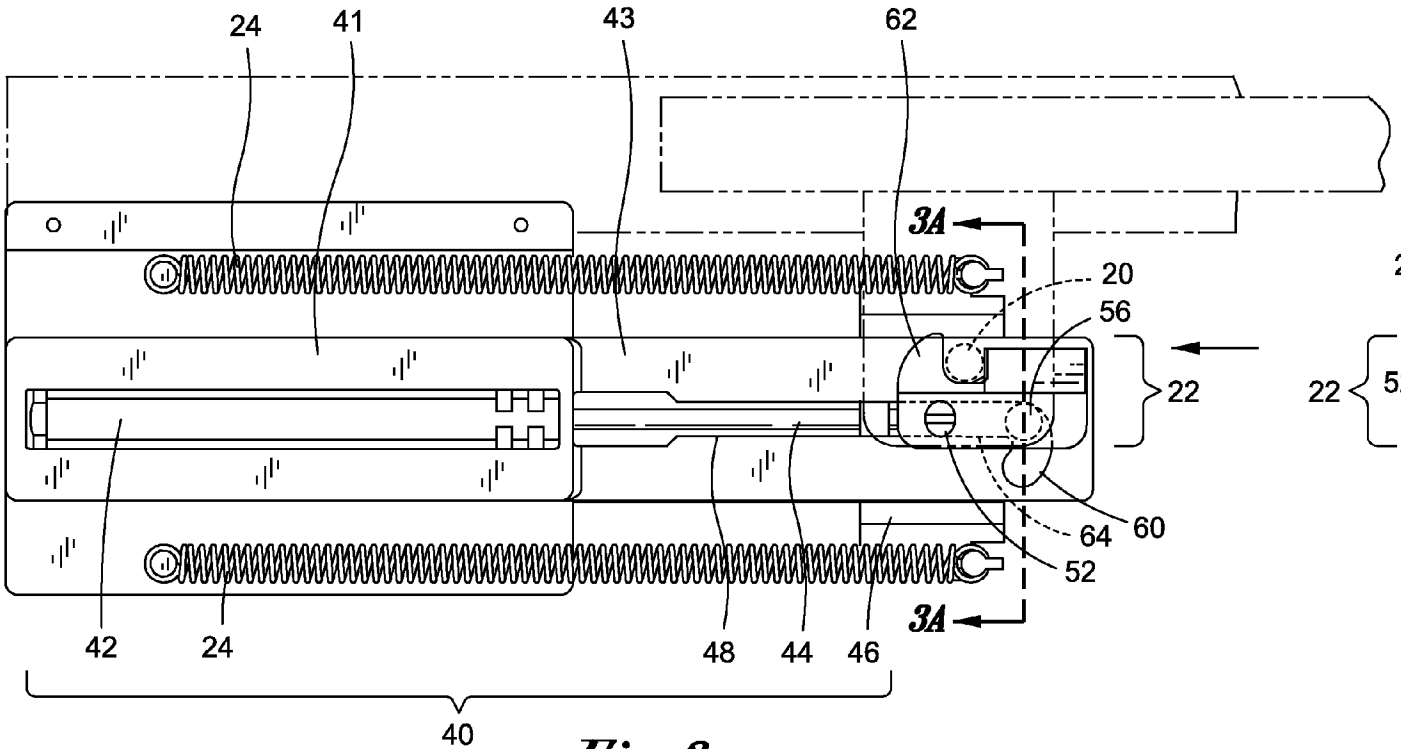
FIG. 3 is a side view of the auto-close-dampening system with reset feature with an actuator in an engaged and extended position.

An enlarged illustration of the auto close mechanism 14 is shown in FIG. 2. The auto close mechanism 14 includes a carriage 38 that may be fixedly attached (e.g., pin 31) to the stationary slide member 30. A strut 40 may be mounted within the carriage 38. The strut 40 may include an air shock absorber 42 attached to a base 41 of the carriage and a reciprocating shaft 44 that can be traversed into and out of the shock absorber 42. A stroke length of the reciprocating shaft 44 determines the amount of travel that the auto close mechanism 14 assists in closing the drawer box 16. The shaft 44 may be attached to a common plate 46 that extends behind an extended arm 43 of the carriage 38 and is also attached to the springs 24, as shown in FIGS. 3 and 3A. The extended arm 43 of the carriage 38 may have a track 48 defining a straight portion 64 and an inturned portion 60, as shown in FIG. 3. As the shaft 44 travels into and out of the shock absorber 42, the actuator 22 also travels closer to and further away from the shock absorber 42. The actuator 22 remains in the engaged position (see FIGS. 3 and 4) while the actuator 22 is in the straight portion 64. As the actuator 22 approaches the inturned portion 60, the actuator 22 is pivoted as shown in FIGS. 2 and 7 to the released position.

Referring now to FIG. 2, the common plate 46 has a first protrusion 50 that is fixedly attached to a distal end portion of the reciprocating shaft 44. The common plate 46 may additionally have a split protrusion 52 that may protrude through the track 48 and may be received within an aperture 54 of the actuator 22. The split protrusion 52 remains within the straight portion of the track 48 as the actuator 22 is traversed between the extended and retracted positions. The actuator 22 may additionally have a protrusion 56 extending to the back side of the actuator 22, as shown in FIG. 3A. The protrusion 56 also travels within the track 48. However, as the actuator 22 approaches the inturned portion 60 of the track 48 (see FIG. 3), the protrusion 56 may be pushed into the inturned portion 60 of the track 48. In particular, as shown in FIG. 7, as the pin 20 is being disengaged from the catch 28 of the actuator 22, the pin 20 may contact an apex 58 of the ramp 26. This pushes the pin 20 into the inturned portion 60 of the track 48 and rotates the actuator 22 to the release position (see FIG. 7). The protrusion 56 is now disposed within the inturned portion 60 of the track 48. After the pin 20 is released from the catch 28, the springs 24 bias the actuator 22 back toward the shock absorber 42. However, since the inturned portion 60 of the track 48 is reversed, the springs 24 pull the protrusion 56 further into the inturned portion 60 of the track 48. The protrusion 56 prevents the traversal of the actuator 22 back toward the shock absorber 42 since the protrusion 56 is caught within the inturned portion 60 of the track 48. The drawer box 16 can now be opened fully so that a user may access the content within the drawer box 16 or place additional objects within the drawer box 16.

When the user is done accessing the drawer box 16, the user begins to close the drawer box 16. The pin 20 is traversed closer to the actuator 22, as shown in FIG. 7. The pin 20 enters the catch 28. As the user pushes the drawer box 16 further to the closed position, the pin 20 pushes a tang 62 of the actuator 22 to rotate the actuator 22 back to an engaged position, as shown in FIG. 3. Once the pin 20 is disposed within the catch 28 and the actuator 22 is traversed to the engaged position, the protrusion 56 is now within the straight longitudinal section 64 of the track 48. Also, as discussed above, the split protrusion 52 is disposed within the straight portion of the track 48. After the actuator 22 is moved back a bit, the protrusion 56 can no longer be rotated back into the inturned portion 60 of the track 48. As such, the pin 20 remains within the catch 28. The springs 24 now pull the actuator 22 back. The shock absorber 42 prevents the drawer box 16 from accelerating back to the closed position. Rather, the shock absorber 42 regulates the springs 24 to allow the drawer box 16 to be gently and slowly pulled back to the closed position. Additionally, since the pin 20 is attached to the drawer box 16, the drawer box 16 is traversed automatically to the closed position under the bias force of the springs 24.

Figure 4:
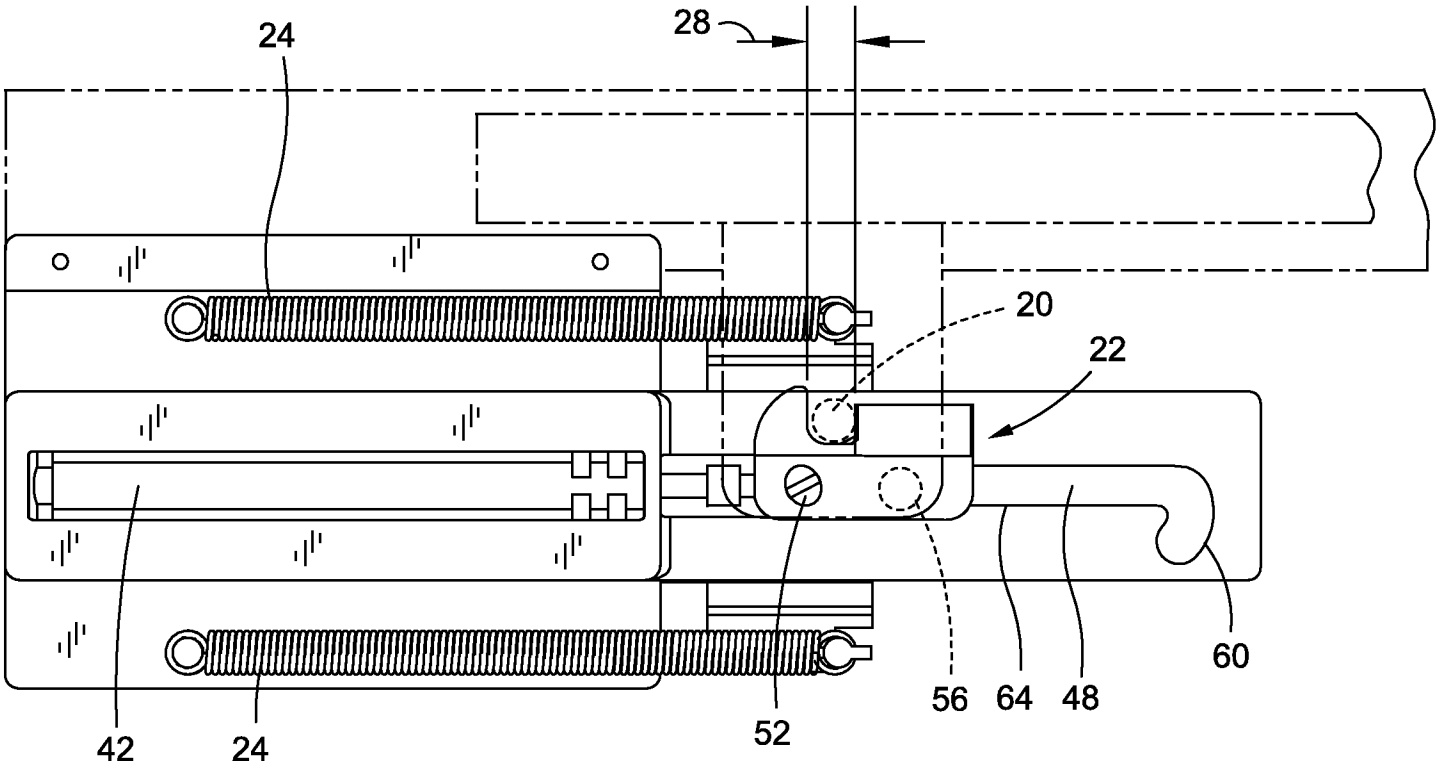
FIG. 4 illustrates the actuator of FIG. 3 in an engaged and retracted position.
Figure 7:
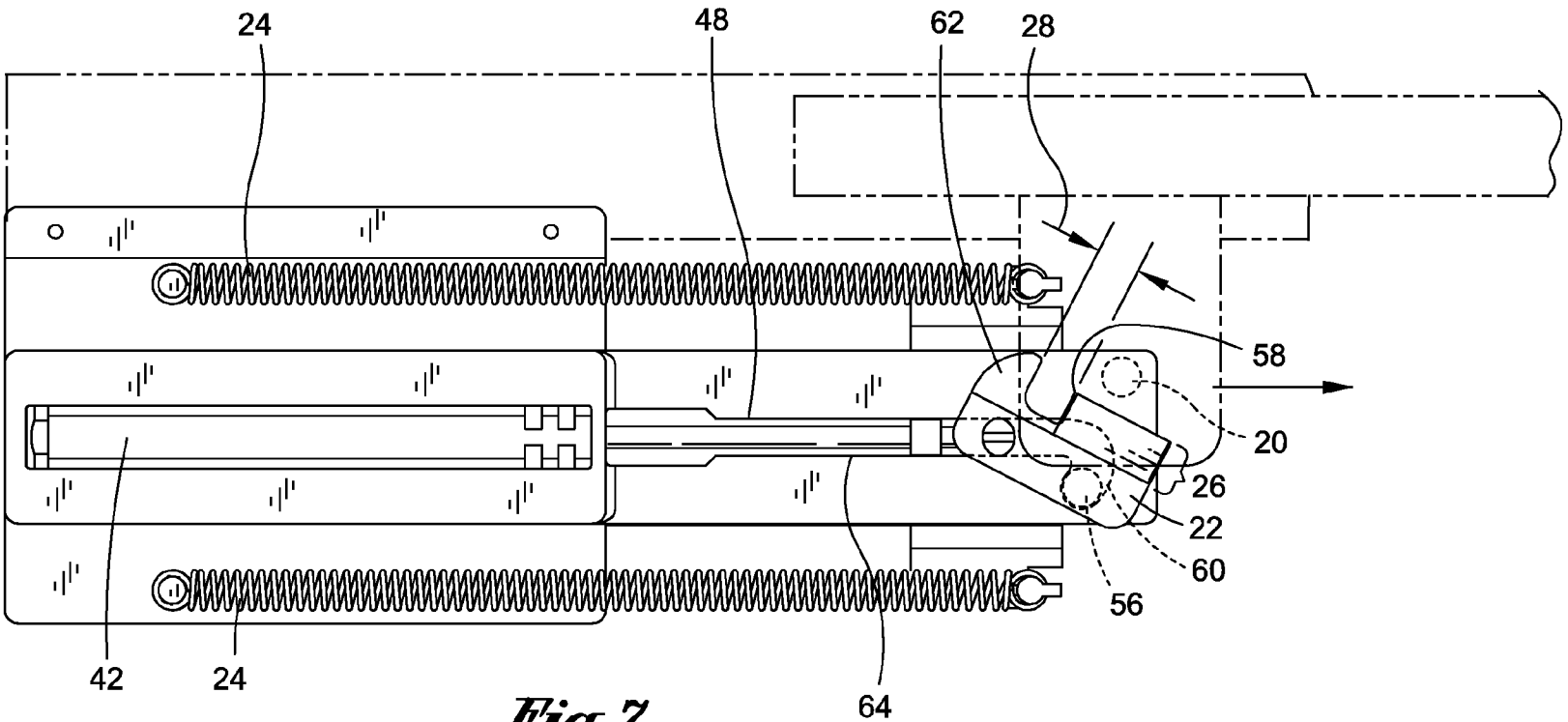
FIG. 7 illustrates the auto-close-dampening system with the actuator in a released and extended position.

Referring to FIG. 7, when the pin 20 is released from the catch 28 of the actuator 22, the protrusion 56 is engaged to the inturned portion 60 of the track 48 to prevent the springs 24 from traversing the actuator 22 back to the retracted position (see FIG. 4). Unfortunately, sometimes the actuator 22 may be rotated back to the engaged position (see FIG. 5) after the pin 20 is released from the catch 28. This may occur for various reasons such as jostling, malfunction, tolerance issues, etc. If the actuator 22 is accidentally rotated to the engaged position, the actuator 22 will be traversed back to the retracted position under power of the springs 24 even if the pin 20 is not disposed within the catch 28 of the actuator 22, as shown in FIG. 5. In this instance, as the user pushes the drawer box 16 closed, the auto close mechanism 14 does not operate to close the drawer box 16 due to the malfunction of the auto close mechanism 14. Fortunately, the actuator 22 has a ramp 26 that permits resetting of the auto close mechanism 14 in the event of a malfunction. In particular, as the drawer box 16 is traversed to the closed position, the pin 20 is traversed in the direction of arrow 18 as shown in FIGS. 5 and 5A. The pin 20 is aligned to the carriage 38 so that the pin 20 is traversed in front of the extended arm 43 of the carriage 38, as shown in FIG. 6. Moreover, the pin 20 is aligned to a ramp surface 70 so that the pin 20 initially contacts the ramp surface 70, is pushed over the ramp 26 and reengages with the catch 28 also shown in FIG. 6.

The pin 20 may be attached to an extension 68 (see FIG. 5) which is fixedly attached to the telescoping slide member 32. As the drawer box 16 is traversed toward the closed position, the telescoping slide member 32, the extension 68 and the pin 20 are traversed in the direction of arrow 18 shown in FIGS. 5 and 6. Generally, the pin 20 is aligned to the ramp surface 70 of the ramp 26. In particular, a distal end 72 of the pin 20 may be disposed in front of the extended arm 43 of the carriage 38 and may initially contact the ramp surface 70 as the pin 20 is traversed in the direction of arrow 18. After the distal end 72 of the pin 20 contacts the ramp surface 70, the pin 20 is pushed over the ramp 26. To this end, the extension 68 (see FIG. 5) may bend and/or the slack or play between the stationary slide member 30 and the telescoping slide member 32 may allow the pin 20 to be pushed over the ramp 26. Once the pin 20 traverses over the ramp 26, the pin 20 is urged into the catch 28. In particular, as discussed above, the pin 20 is pushed over the ramp 26 by either the bending of the extension 68 or the slack between the stationary and telescoping slide members 30, 32. However, the normal position of the pin 20 is such that the pin 20 should be disposed within the catch 28. As such, when the pin 20 is pushed entirely over the ramp 26, the pin 20 is urged into the catch 28. Moreover, a diameter 74 of the pin 20 is equal to or preferably slightly less than a width 76 of the catch 28 so that the pin 20 can be urged into the catch 28 once the pin 20 is pushed entirely over the ramp 26.

In operation, the auto close mechanism 14 may initially be in the state shown in FIG. 4. The actuator 22 is in the engaged and retracted position. The pin 20 is disposed within the catch 28. The actuator 22 cannot be rotated about split protrusion 52 because the protrusions 52 and 56 are now currently disposed within the straight elongate portion 64 of the track 48. In this position, the drawer box 16 is in the closed position and remains in the closed position until the user pulls the drawer box 16 toward the open position. If the user does not pull the drawer box 16 toward the open position, then the drawer box 16 will remain in the closed position despite environmental forces that may urge the drawer box 16 toward the opened position. By way of example and not limitation, in an earthquake, the drawer box 16 may be urged toward the opened position, but the auto close mechanism 14 may maintain the drawer box 16 in the closed position. Additionally, if the auto close mechanism 14 is employed on a drawer 12 of an airplane, then the drawer box 16 may be urged toward the opened position as the plane pitches and rolls in the air. Fortunately, the auto close mechanism 14 maintain the drawer box 16 in the closed position. The springs 24 and the air shock absorber 42 maintain the drawer box 16 in the closed position despite environmental forces that may urge the drawer box 16 toward the opened position. The user dictates when the drawer box 16 will be traversed toward the opened position by pulling on a handle 78 (see FIG. 1) attached to the drawer box 16.

When the user pulls on the handle 78 of the drawer box 16, the telescoping slide member 32 is slid out of the stationary slide member 30. Additionally, the actuator 22 is also traversed toward the extended position (see FIG. 3). The protrusion 56 and the split protrusion 52 of the actuator 22 remain in the straight portion 64 of the track 48 so that the pin 20 is not released from the actuator 22 as the actuator 22 is traversed toward the extended position. The springs 24 bias the actuator 22 back toward the retracted position such that the user must overcome the spring force of the springs 24 to open the drawer box 16. The dampener also provides additional resistance to preventing accidental opening of the drawer box 16. As the user continues to traverse the drawer box 16 toward the opened position, the protrusion 56 approaches the inturned portion 60 of the track 48, as shown in FIG. 3. Since the pin 20 is located above the split protrusion 52, the pin 20 pushes against ramp 26 to urge the actuator 22 in the clockwise direction about the split protrusion 52. The protrusion 56 of the actuator 22 is now pushed into the inturned portion 60 of the track 48, as shown in FIG. 7. To ensure that the protrusion 56 of the actuator 22 is urged into the inturned portion 60, the pin 20 may contact and hit the apex 58 of the ramp 26. Once the pin 20 is released from the catch 28 of the actuator 22, the user continues to traverse the drawer box 16 toward the fully opened position. The springs 24 urge the actuator 22 back toward the retracted position. However, since the protrusion 56 of the actuator 22 is now disposed within the inturned portion 60 of the track 48, the springs 24 bias the protrusion 56 of the actuator 22 further into the inturned portion 60 of the track 48. The actuator 22 remains in the extended and released position (see FIG. 7) until the user traverses the drawer box 16 back toward the closed position.

When the user traverses the drawer box 16 back toward the closed position, the pin 20 approaches the catch 28 of the actuator 22. The pin 20 contacts a tang 62 of the actuator 22 so as to urge the actuator 22 in the counterclockwise direction about the split protrusion 52 and also urge the protrusion 56 of the actuator 22 back into the straight portion 64 of the track 48. Once the protrusion 56 of the actuator 22 is in the straight portion 64 of the track 48 (see FIG. 3), the springs 24 pull the actuator 22 back toward the retracted position. Once both the split protrusion 52 and the protrusion 56 of the actuator 22 are in the straight portion 64 of the track 48, the actuator 22 cannot pivot. The pin 20 is now locked in the catch 28. The springs 24 in conjunction with the strut 40 (i.e., shock absorber 42) aid in slowly and gently closing the drawer box 16 to the closed position. The strut 40 prevents the springs 24 from quickly and abruptly bringing the drawer box 16 back to the closed position.

This process is repeated each time the drawer box 16 is opened and closed. Unfortunately, sometimes when the pin 20 is released from the catch 28, as shown in FIG. 7, the actuator 22 may accidently and inadvertently be traversed back to the engaged position and be rotated in the counterclockwise direction. In this event, the protrusion 56 and the split protrusion 52 of the actuator 22 are now in the straight portion 64 of the track 48. The springs 24 urge the actuator 22 back to the retracted and engaged position even though the pin 20 is not disposed in the catch 28, as shown in FIG. 5. The drawer box 16 can be opened. However, when the drawer box 16 is closed, the auto close mechanism 14 fails to operate. The auto close mechanism 14 does not assist in the closing of the drawer box 16 as discussed above.

The auto close mechanism 14 shown in FIG. 5 has a reset feature. In particular, the reset feature includes the ramp 26 in the actuator 22. The ramp 26 is aligned to the pin 20 as shown in FIGS. 5 and 6. When the drawer box 16 is pushed toward the closed position, the pin 20 which is aligned to the ramp 26 contacts ramp surface 70 which urges the pin 20 over the ramp 26. When the pin 20 is pushed entirely over the ramp 26, the pin 20 then reengages with the catch 28 to reset the auto close mechanism. The next time the drawer box 16 is opened, the auto close mechanism 14 will operate as discussed above.

The carriage 38 is described as being attached to the stationary slide member 30 and the pin 20 in fixed relation with the telescoping slide member 32. However, it is also contemplated that the reverse configuration may also be fabricated. In particular, the pin 20 may be fixedly attached to the stationary slide member 30 and the carriage 38 may be fixedly attached to the telescoping slide member 32. The pin 20 may be in alignment with the ramp 26 of the actuator 22 that slides within a track 48 of the carriage 38 as described above.

The above description is given by way of example, and not limitation. Given the above disclosure, one skilled in the art could devise variations that are within the scope and spirit of the invention disclosed herein, including various ways of dampening the shaft 44. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A slide for a drawer having a frame and drawer box, the slide comprising:

a stationary slide member attachable to the frame of the drawer;

a telescoping slide member slideable with respect to the stationary slide member between an extended position and a retracted position, the telescoping slide member attachable to the drawer box for traversing the drawer box between an opened position and a closed position;

an arm connected to the stationary slide member and having a slot formed therein; and an auto close mechanism with reset feature attached to both the stationary and telescoping slide members, the auto close mechanism with reset feature comprising:

a pin in fixed relative position with respect to the telescoping slide member and the drawer box; and an actuator connected to the arm and slidable within the slot, the actuator being biased toward a retracted position and traversable to an extended position as the drawer box is traversed to the opened position, the actuator having a catch traversable between an engaged position so that the actuator and the pin are in fixed relative position to each other for auto closing the drawer box and a release position so that the pin is released from the actuator for allowing the drawer box to be traversed to the opened position, the actuator defining a leading portion having a ramp configuration for resetting the auto close mechanism when the actuator is inadvertently traversed to the engaged position when the drawer box is in the opened position, wherein the slot includes a generally straight segment and a curved segment.

2. The slide of claim 1, wherein the catch transitions from the engaged position to the release position as the actuator moves from the generally straight segment to the curved segment.

3. The slide of claim 1, wherein the actuator pivots relative to the arm as the actuator moves from the generally straight segment to the curved segment.

4. A slide for a drawer having a frame and drawer box, the slide comprising:

a stationary slide member attachable to the frame of the drawer;

a telescoping slide member slideable with respect to the stationary slide member between an extended position and a retracted position, the telescoping slide member attachable to the drawer box for traversing the drawer box between an opened position and a closed position;

an arm connected to the stationary slide member and having a slot formed therein; and an auto close mechanism with reset feature attached to both the stationary and telescoping slide members, the auto close mechanism with reset feature comprising:

a pin in fixed relative position with respect to the telescoping slide member and the drawer box; and an actuator connected to the arm and slidable within the slot, the actuator being biased toward a retracted position and traversable to an extended position as the drawer box is traversed to the opened position, the actuator having a catch traversable between an engaged position so that the actuator and the pin are in fixed relative position to each other for auto closing the drawer box and a release position so that the pin is released from the actuator for allowing the drawer box to be traversed to the opened position, the actuator defining a leading portion having a ramp configuration for resetting the auto close mechanism when the actuator is inadvertently traversed to the engaged position when the drawer box is in the opened position, wherein the ramp configuration is integrally formed with the actuator.

5. A slide comprising:

a stationary slide member;

a telescoping slide member translatably coupled to the stationary slide member between a retracted position and an extended position, wherein a portion of the telescoping slide member moves away from the stationary slide member as the telescoping slide member moves from the retracted position to the extended position;

a pin coupled to the telescoping member and moveable relative to the stationary slide member;

an arm coupled to the stationary slide member and including a slot formed therein;

an actuator coupled to the arm and releasably engageable with the pin;

the actuator being traversable within the slot and transitional between a first position and a second position, in the first position the actuator being configured to maintain engagement with the pin, in the second position the actuator being configured to release the pin as the telescoping slide member moves from the retracted position toward the extended position and receive the pin as the telescoping slide member moves from the extended position toward the retracted position;

the actuator having a ramp along which the pin traverses to facilitate engagement between the actuator and the pin when the actuator is in the first position and the telescoping slide member is moved from the extended toward the retracted position, wherein the slot includes a generally straight segment and a curved segment.

6. The slide of claim 5, wherein the actuator transitions from the engaged position to the release position as the actuator moves from the generally straight segment to the curved segment.

7. The slide of claim 5, wherein the actuator pivots within the slot as the actuator moves from the generally straight segment to the curved segment.

8. A slide comprising:

a stationary slide member;

a telescoping slide member translatably coupled to the stationary slide member between a retracted position and an extended position, wherein a portion of the telescoping slide member moves away from the stationary slide member as the telescoping slide member moves from the retracted position to the extended position;

a pin coupled to the telescoping member and moveable relative to the stationary slide member;

an arm coupled to the stationary slide member and including a slot formed therein;

an actuator coupled to the arm and releasably engageable with the pin;

the actuator being traversable within the slot and transitional between a first position and a second position, in the first position the actuator being configured to maintain engagement with the pin, in the second position the actuator being configured to release the pin as the telescoping slide member moves from the retracted position toward the extended position and receive the pin as the telescoping slide member moves from the extended position toward the retracted position;

the actuator having a ramp along which the pin traverses to facilitate engagement between the actuator and the pin when the actuator is in the first position and the telescoping slide member is moved from the extended toward the retracted position, wherein the ramp is integrally formed with the actuator.

* * * * *